United States Patent [19]

Balordi

[11] 4,092,949

[45] June 6, 1978

[54] CONTAINER ROLLBACK DETECTOR AND COATING APPARATUS

[75] Inventor: Romano Balordi, Millers, Md.

[73] Assignee: Crown Cork & Seal Company, Inc., Philadelphia, Pa.

[21] Appl. No.: 746,941

[22] Filed: Dec. 2, 1976

[51] Int. Cl.[2] ..... B05C 1/02; B05C 13/02

[52] U.S. Cl. ..... 118/6; 101/40; 118/230; 118/232; 209/80

[58] Field of Search ..... 101/40; 209/80; 118/6, 118/9, 230, 232, 50

[56] References Cited

U.S. PATENT DOCUMENTS

| | | | |
|---|---|---|---|
| 2,272,073 | 2/1942 | Von Sydow et al. | 118/230 X |
| 2,369,871 | 2/1945 | Trollen | 118/230 X |
| 3,996,851 | 12/1976 | Urban | 101/40 |

*Primary Examiner*—John P. McIntosh
*Attorney, Agent, or Firm*—Woodcock, Washburn, Kurtz & Mackiewicz

[57] ABSTRACT

Apparatus for causing drawn and ironed cans having rolled-back edges to be detected as faulty and discharged by state-of-the-art can transfer and coating systems. An arcuate shoe is disposed so as to frictionally engage, and cause the rotation of, can-receiving mandrels. A rigid, arcuate arm is disposed adjacent the path of the mandrels, far enough away to allow acceptable cans to slide over the mandrels but close enough to prevent cans having rolled-back edges from doing so. The cans which are prevented from fully seating upon the mandrels are then discharged from the mandrels by air pressure.

14 Claims, 3 Drawing Figures

CONTAINER ROLLBACK DETECTOR AND COATING APPARATUS

BACKGROUND OF THE INVENTION

The present invention relates to container transfer mechanisms and more particularly to means for effecting the detection of improperly-formed metallic cans.

In recent years the construction of metal cans has changed considerably so that the so-called "two piece" or drawn and ironed can bodies have to a great extent supplanted the previously-used "three piece" bodies. The latter type of can was conventionally formed by rolling a flat strip of stock into a cylinder and sealing the axial seam. A separate, circular end member was then attached to the can to close one end. After the can was filled a third circular end member was then attached to the can to close it. The drawn and ironed two-piece can, on the other hand, comprises unitary side and end walls, so that only the later-applied top member is separable from the body.

The latter type of can body is ordinarily formed through a process termed "drawing and ironing" wherein a rough body blank is first struck into a generally shallow, cup-shaped configuration. The rough cup blank is then deep-drawn, and subsequently forced through a set of annular dies of decreasing diameter to axially elongate the sidewall so as to form a one-piece can body. This is done by urging the cup-shaped blank through appropriate dies by a piston-like ram.

As is well known by those skilled in the art the drawing and ironing process, while it elongates the cylindrical sidewalls of the can body, produces an irregular edge at the mouth of the can. Thus as the ram retreats from its final, extended position and the newly formed can body is stripped from it, the ragged edges of the can body are occasionally bent backwards as they are engaged by the stripping means. In this manner the open edge or mouth of the can is rolled back so as to form a razor sharp, protruding flange. When the can is passed to the succeeding work station, a shearing device ordinarily removes the rough, irregular edge of the can. Occasionally, however, the shearing means or trimmer does not remove all of the rolled-back edge section, particularly where it has been distorted below the area at which trimming occurs.

Aside from this, flaws in the trimming process and other incidents undergone by the can as it is formed and transported during the manufacturing process occasionally leave the semi-finished can with a sharp, protruding edge member known in the art as "rollback". The rollbacks occasionally cause malfunctions and jamming in subsequent processing and/or transporting machinery. While jamming and the like is most undesirable, it is not nearly as expensive or time-consuming as is the result when a rollback encounters coating apparatus of the type commonly used for coating the outsides of the cans.

Conventionally, such a coating apparatus comprises a large roller which spins at high speed and whose periphery is continually supplied with coating material, such as an appropriate lacquer or enamel. The surface of the roller, termed an "application roll" is usually of a soft rubber composition which assures a thorough contact with the surface of the passing cans. Unfortunately, the printing blanket surface is easily damaged by sharp, protruding rollback of a defective can, and, once damaged, proceeds to apply a defective coating to succeeding cans. Aside from the fact that application or coating rolls are relatively expensive to replace, the time involved in dismantling the coating machinery roll and replacing the roll is relatively great. During the replacement time the production of cans necessarily ceases, so that still greater expense is incurred.

While many efforts have been made to develop apparatus for detecting cans having rolled-back edges, to date even the most modest approaches have entailed sophisticated sensing and detecting equipment which is both expensive and susceptible to failure. Accordingly, it will be understood that it would be highly desirable to provide means for detecting the presence of can rollbacks to allow their ejection from the manufacturing stream before they encounter the coating roll of a coating apparatus.

It is therefore an object of the present invention to provide an improved rollback detecting means.

It is another object of the invention to provide a rollback detector which is adapted for use with conventional can transfer and coating equipment.

Still another object is to provide a simple and inexpensive rollback detector which is highly reliable in use.

Yet another object is to provide a safe and effective means for causing the ejection of rolled-back cans from the manufacturing stream.

SUMMARY OF THE INVENTION

Briefly stated, in accordance with one aspect of the invention, the foregoing objects are achieved by providing an arcuate shoe disposed about the path of can-bearing mandrels for frictionally engaging the mandrels to cause them to rotate. A rigid, arcuate arm is mounted adjacent the path of the thus-rotated mandrels at a point along the lengths thereof which will be traversed by the edges of the cans as they are urged over the mandrels. The stripper extends past the point at which the cans cease to be urged over the mandrels, and is close enough to the mandrels so that only enough clearance is provided for properly-formed can sidewalls. Upset or rolled-back edges which protrude radially outwardly of the can sidewalls strike the arm and are kept from seating further upon the mandrels. Cans which are thus prevented from seating are subsequently detected by conventional detector means and discharged from the mandrel by pneumatic pressure.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
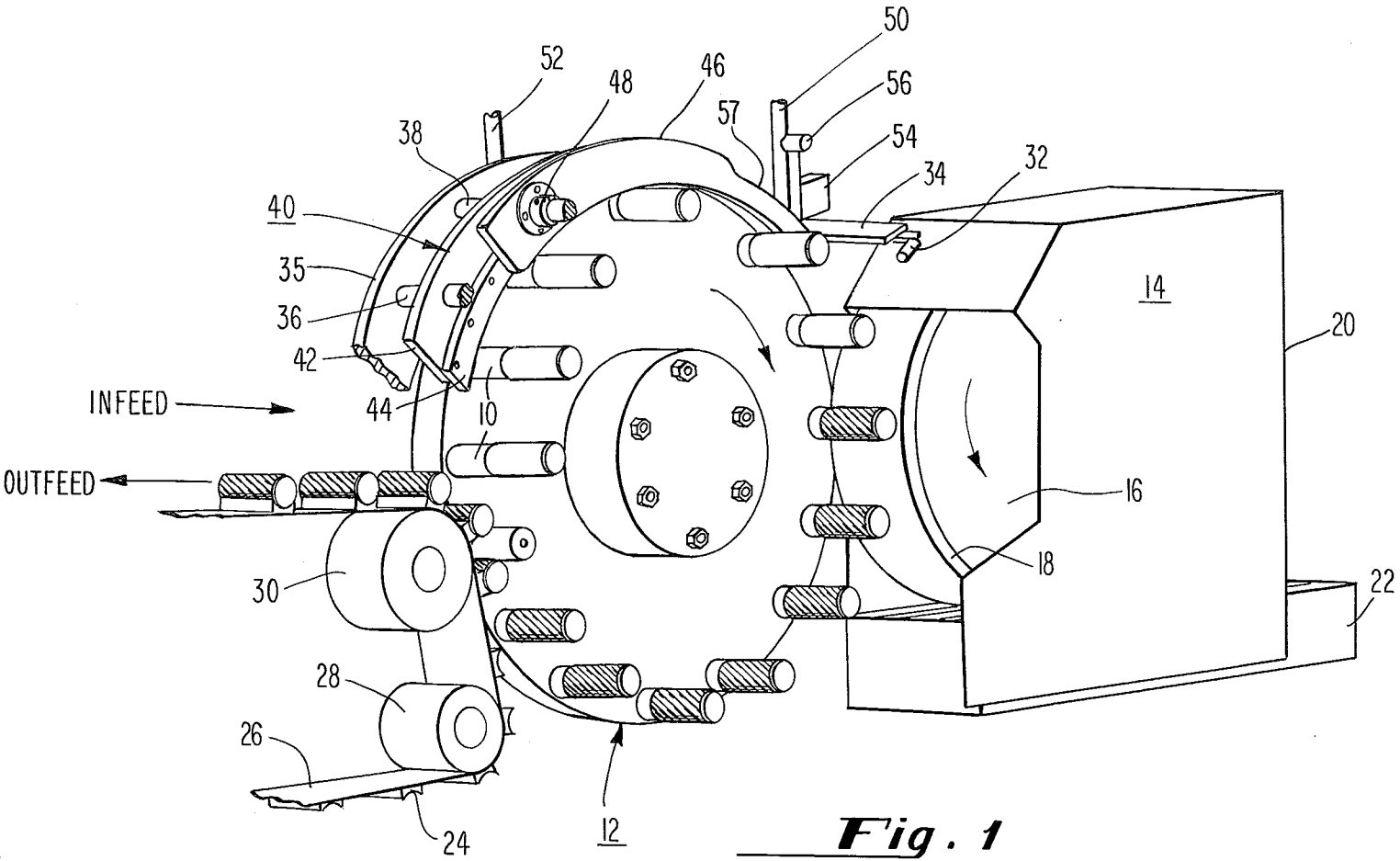
FIG. 1 is a perspective view of a conventional coating apparatus with the present invention attached thereto.

FIG. 1 depicts a conventional coating station for applying a coating to the exterior of rapidly-transferred drawn and ironed cans. The apparatus depicted is intended to represent a Model 800 coating machine, manufactured by the Rutherford Manufacturing Company of East Rutherford, N.J. In order to facilitate the description the system is shown in somewhat simplied form, the details of the apparatus which are not relevant to the present invention being omitted or simplified. A description of a related type of container transfer and printing mechanism is set forth in copending U.S. Pat. No. 3,996,851, entitled "Container Printing Apparatus", issued Dec. 14, 1976, in the name of Joseph J. Urban and assigned to the assignee of the present invention.

A transfer mechanism (not shown) which may comprise a conventional belt carrier, spiral transfer shaft, or the like, brings newly-formed, uncoated cans to the general location indicated by the legend "infeed". Each received can is inserted over the protruding end of a mandrel 10, which is rotatably mounted upon a transfer drum 12. The transfer drum is itself journaled upon a shaft or the like and rotated by appropriate means, such as a gear train driven by a large electric motor. As transfer drum 12 rotates clockwise, succeeding mandrels pass the "infeed" position and have cans placed thereon. As is known by those skilled in the art, the cans are conventionally placed only part-way over the end of each mandrel, so that the mandrel does not protrude fully within the can.

At the far side of the transfer drum 12 is a coating apparatus generally designated at 14. The apparatus includes a rotating drum 16 upon whose periphery is disposed a rubber coating roll 18. Conventionally drum 16 is driven through gears, shafts or the like coupled to the drive system of transfer drum 12 so that the elements rotate in predetermined relation to one another. The drum is carried by a moving carriage, which is obscured by a hood 20. The carriage is slidably mounted upon a base 22 so that it may move toward and away from transfer drum 12.

The coated cans are subsequently removed from succeeding mandrels by suction cups and disposed in cradles 24 upon a moving belt or on a transfer pin chain 26, which is trained about sprockets 28, 30 in the manner shown. In this manner the coated cans are transported from the coated station to the next work station of the material flow system.

A sensor 32, which conventionally comprises a proximity detector, is affixed to a protruding arm or support 34 so that it comes in close proximity with the distal ends of cans mounted upon the passing mandrels. Cans which are fully seated upon the mandrels, however, pass inwardly of the sensor, as it is assumed that cans which are fully seated upon the mandrel are not indented or crumpled and therefore defect-free. As illustrated in the aforementioned patent application Ser. No. 596,649 a belt, drum or the like (not shown) encounters succeeding ones of the mandrels as they approach the region of printing drum 16, spinning the mandrels so that the cans will be moving generally in synchronization with the surface of coating roll 18. This allows better registration of the blanket upon the can surface, and avoids skipping or smearing of the coating. With the apparatus illustrated the infeed rails are conventionally supported by a pair of beams, one of which is illustrated at 35, the other not shown. The beams are coupled together by a pair of elongate bars 36, 38 which are ordinarily cylindrical in form.

According to the present invention, a shoe 40, comprising a backing plate 42 and a frictional member 44, are secured to the apparatus by slipping the backing plate over bars 36, 38. If desired, the backing plate can be affixed to the bars by means of a conventional flange, collar or the like. Further according to the invention, an arcuate stripper arm 46 is affixed to one of the bars 38 by means of a flange 48. The lower surface of the stripper bar forms an arc concentric with the paths of the mandrels 10, and is located above the uppermost mandrels with just enough clearance to allow for the passage of the sidewall of a can thereunder. Pneumatic and vacuum lines 50, 52 respectively supply pressurized air for operating certain portions of the transfer mechanism.

Operation of the system of FIG. 1 will now be described in detail, making reference to the elements heretofore enumerated. As newly-formed cans are presented to the mandrels 10 of the transfer drum 12 through the infeed mechanism, each can is in its turn placed part way over the mandrel. Soon thereafter, the innermost end of the mandrel encounters the frictional portion 44 of the shoe apparatus 40, whereupon the mandrel is caused to rotate as it rolls along the lower edge of the frictional member. As the transfer disk 12 continues to rotate, appropriate valving and manifolding causes a vacuum to be drawn through passages which open in apertures at the end of the mandrels. The vacuum which is thus created within each can body serves to draw the can fully upon the mandrel as the drum rotates.

According to present practice, cans which are crushed or damaged or otherwise defective cannot be fully seated upon the mandrel by the vacuum drawn therein. Accordingly, such cans protrude outwardly beyond the ends of the mandrels upon which they rest. As they pass proximity detector 32 their irregular protruding position is detected by appropriate signal processing circuitry, and as a result pressurized air is directed through the mandrel to forcibly discharge the damaged can. In some instances, detection of a faulty can causes the carriage supporting coating drum 16 to be moved backwardly upon its base 22 so that destructive interference between printing blanket 18 and the surface of the damaged can is avoided.

In the illustrated embodiment, signal processing means within housing 54 responds to the detection of a non-seated can by applying power to a solenoid valve 56, thus allowing pressurized air from conduit 50 to be selectively applied to the mandrel upon which the faulty can is detected.

In prior art systems using proximity detectors of the type just described as the sole means of detecting faulty cans, cans having protruding, rolled-back lips frequently went undetected since they were able to be fully seated upon their respective mandrels. With the present invention, arcuate stripper arm 46 is disposed in close proximity to the passing mandrels. In this manner, should a can which has an upset or rolled-back lip be placed upon a mandrel the inner edge of stripper arm 46 will interfere with the protruding rollback and prevent the can from seating fully upon the mandrel. The length of the stripper arm is such that it encompasses a greater arc of rotation of transfer drum 12 than does the vacuum valving system, so that the stripper arm resists the inward urging effect of the vacuum upon the can and keeps the can from seating upon the mandrel until well after the vacuum has been released. Without the pressure of the vacuum system the can will keep its protruding position on the mandrel as it rotates, so that it passes beneath detector 32. As the can encounters the field of the detection sensor the reject circuitry is activated, and the can is discharged from the apparatus in the same manner as any other defective can. This avoids an encounter between the sharp, protruding edge of the rolled-back portion of the can and printing blanket 18 which would destroy the surface of the printing blanket and cause a stoppage of product flow.

A further aspect of the present invention inheres in the manner of the mounting of the stripper bar. In a presently preferred embodiment, the stripper arm 46 is frictionally and pivotally mounted upon bar 38 by means of flange 48. As illustrated, the flange may be bolted or otherwise fixedly attached to the stripper arm, and clamped upon bar 38 through the provision of a radial slot in the flange which is spanned by a bolt or the like so as to squeeze the flange tightly about the surface of the bar. It has been found that this manner of mounting securely holds the stripper bar in its intended position while the bar performs its function of holding cans having rolled-back edges from seating upon the mandrels. At the same time, should a severely damaged can become wedged beneath the stripper bar the resulting pressure will force the stripper arm upwardly so that no destructive breakage will occur. While the specific material from which the stripper arm is made is not critical, frangible resin-impregnated fibrous industrial laminates such as Micarta, which is manufactured and sold by the General Electric Company, have been found to function satisfactorily. Further, as will be more fully disclosed hereinafter the arcuate stripper arm 46 terminates in an end portion 57 which is of reduced cross-sectional area. In this manner, if the arm is subjected to extraordinary pressure it will fracture in the latter region rather than at the heavier, principal portion of the arm. The thinner end portion 57 thus acts as a "safety valve" to prevent significant damage to the rollback detection apparatus and the members upon which it is mounted.

Figure 2:
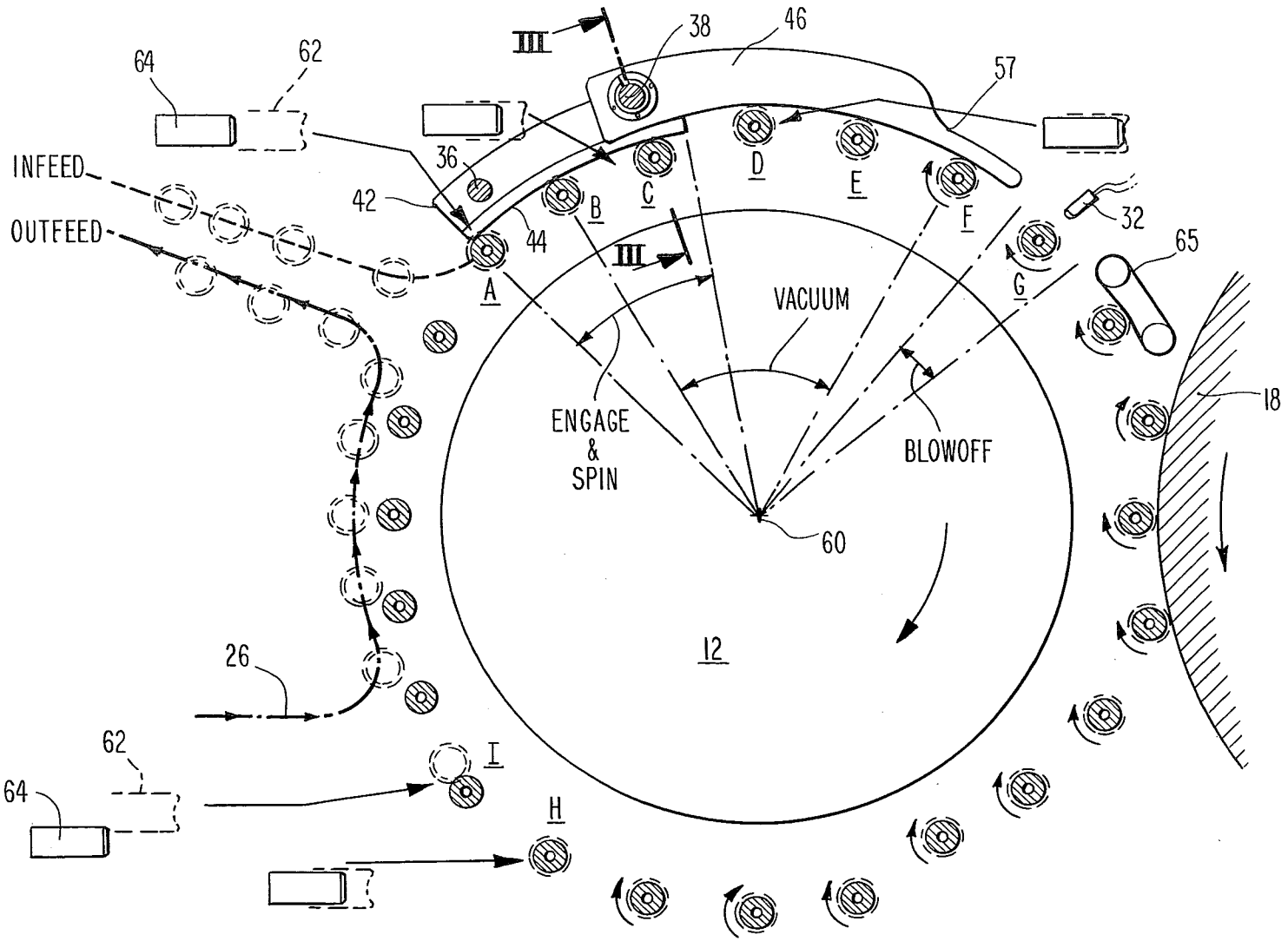
FIG. 2 is a functional diagram illustrating the operation of the apparatus of FIG. 1 in conjunction with the inventive means.

Turning now to FIG. 2, there is shown a layout of the machine of FIG. 1 in diagrammatic form so as to more fully illustrate the timing and orientation of the various elements. Transfer drum 12 rotates upon an axis of rotation 60 at a regular rate, which advantageously bears a fixed relationship with the rate of rotation of the drum carrying coating roll 18. Further details of one system of the type under consideration may be observed from the Model 800 roll coater coating station sold by the Rutherford Company of East Rutherford, N.J. As is conventional with such systems newly-formed cans are conveyed to the apparatus along an INFEED path, as indicated in the Figure. Initially an incoming can 62 is aligned with an empty mandrel 64, as shown in the diagrammatic illustration at position A. At positions B and C, the can is drawn over the protruding end of its mandrel until, at or about position D, it is fully seated upon the mandrel substantially as shown.

In a presently preferred embodiment, the cans are urged over the mandrels by drawing a vacuum through each hollow mandrel starting at position B, and extending through position F. An arc representing the duration of the vacuum is represented upon the locus of transfer drum 12. Precedent to the vacuum being drawn, at approximately position A, each mandrel makes frictional contact with a shoe 44 which lies adjacent to the arcuate mandrel pad. In this manner, each mandrel is caused to roll along the shoe at relatively high speed so that each mandrel receives a "spin" which it will maintain for some time after it leaves the shoe, owing to the momentum of the mandrel. The arc encompassed by the shoe is designated "engaged and spin" in the Figure, and advantageously extends some distance past the point at which vacuum is first applied to the mandrels.

At approximately position B, stripper arm 46 closely abuts the passing mandrels. As described hereinabove the inner contour of the stripper arm closely matches the path of the mandrels, the inner edge of the arm being spaced from the mandrel surfaces sufficiently to allow an undeformed can edge to pass thereunder, but closely enough so that an upset edge or rollback will not be allowed to enter. In a successfully-tested embodiment, the stripper arm was positioned approximately 0.008 inch above the surface of a correctly-formed can which typically exhibits a sidewall thickness of approximately .006 inch. This allows sufficient clearance for insubstantial upsets in the can edge to be accommodated, but too little room for rollbacks to fit between the mandrel and the stripper arm.

By causing the freely-journaled mandrels to rotate during this operation, the full periphery of each can must necessarily clear the gap between the mandrel surface and the stripper arm. In practice, it has been found that the rotation of the can-bearing mandrels is sufficiently rapid so that even a short segment of rollback will abut the outer surface of the stripper arm, rather than becoming wedged underneath as the edge describes a helix while being drawn over the mandrel.

At or about station G appropriate manifolding and valving, not visible in FIG. 2, couples each mandrel to a source of compressed air. Proximity sensor 32 then responds to the presence of a protruding can to actuate a solenoid valve or the like, whereupon compressed air is applied through the hollow mandrel to the interior of the can to forcefully eject the can from the mandrel. This arcuate "blowoff" locus need only comprise a short segment of the total arc, as is shown in the Figure. Cans which have fully seated upon their respective mandrels are allowed to pass through the "BLOW-OFF" segment without incident, as it can be assumed that they are neither crushed nor bear rollbacks at their outer edges. Such cans are then brought into contact with an appropriate belt or other spinning apparatus 65 as is conventional with such systems, then impressed against rotating printing blanket 18 whereupon they are coated. The cans then continue about the axis of rotation 60 to a subsequent position H where they commence to be withdrawn from their mandrels. At or about station I they are brought clear of their respective mandrels and transferred to carriers upon an adjacent transfer mechanism such as belt 26, then transferred away from the apparatus by the outfeed path.

Turning once again to a consideration of the cans passing stripper arm 46, should a rollback be present upon the edge of a newly-received can, the radially-extending rollback strikes the lateral side of stripper arm 46 and rubs along it, so that it is positively prevented from being drawn over its respective mandrel. The vacuum being drawn through the hollow mandrel continues to urge the can axially into the plane of the drawing, although the position of the can is maintained constant due to the presence of the stripper arm. At position F, vacuum ceases and the can keeps its position upon the mandrel as the mandrel passes out from under the stripper arm. Since at this point vacuum is no longer present, the can stays partway on the mandrel where it is subsequently sensed by proximity detector 32.

In the event that a badly distorted can somehow becomes jammed between a mandrel and the stripper arm, the forces involved may be great enough to break or severely damage the stripper arm and/or other elements of the system. Needless to say, this will cause extensive damage and necessitate a shutdown of the production line. To avoid this problem, arm 46 is frictionally mounted upon bar 38 by means of a split flange whose axial end is affixed directly to the stripper bar, and which is radially split and clamped about bar 38 by a screw or the like. This affords a strong, reliable mounting for positioning the arm in the exact location required, yet acts much in the manner of a clutch to release the arm in order to prevent a catastrophic jam. Of course, once such an activity occurs the displacement of the arm is readily seen and the offending damaged can may be removed and the stripper arm readily returned to its proper location.

Nonetheless, it has been found that occasionally situations arise wherein a catastrophic jam is encountered near the distal end of stripper arm 46. If the stripper arm is formed of an extremely strong, rigid material, the forces involved in such a jam may destroy other parts which are more expensive and/or difficult to replace. For this reason, the inventor has made the terminal portion 57 of the stripper arm of a substantially reduced cross-sectional area, so that the terminal end of the stripper arm is substantially weaker than the other portions thereof. This allows the end of the arm to fracture when unusually high forces arise, sacrificing the arm in order to save members which are more costly or more easily replaced.

Figure 3:
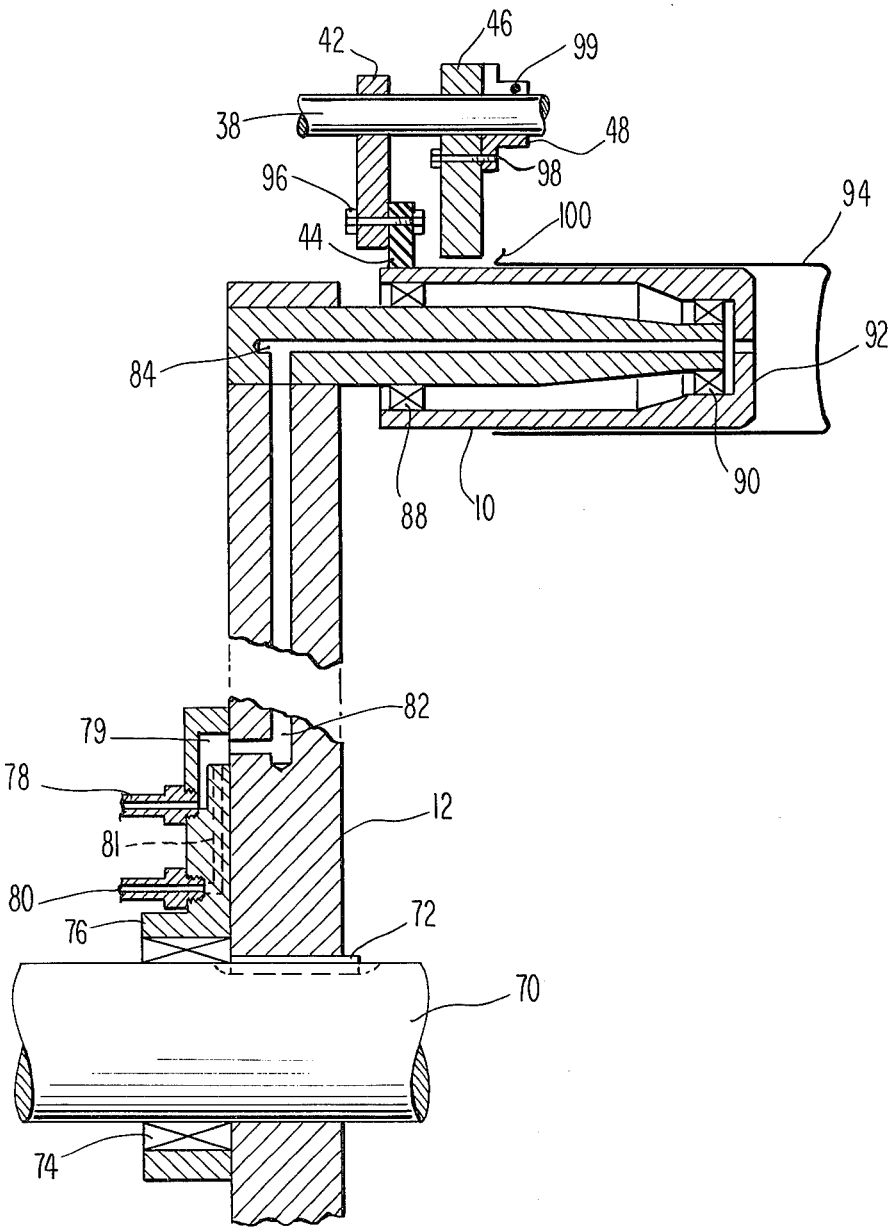
FIG. 3 is a cross-sectional diagram of a portion of the apparatus of FIG. 1 illustrating the operation of the present invention.

FIG. 3 is a cross-sectional diagram taken along a radius III—III of transfer drum 12. The transfer drum is affixed to a drive shaft 70 by means of a key 72 or the like. Journaled upon the shaft by means of an appropriate bearing 74 is a manifold 76 which bears separate passages coupled to a source of vacuum through conduit 78, and air pressure by conduit 80. In the position shown, the passages coupled to the source of vacuum are aligned with a passage 82 which extends through drum 12 and communicates with a corresponding passage 84 within the support element 86 within the mandrel 10. The mandrel is journaled upon the support element by means of bearings 88, 90 and is provided with a port 92 through which pressure in passage 84 may be communicated to a can 94 disposed over the mandrel. In the position shown, vacuum is communicated from conduit 78 to the interior of can 94, tending to draw the can over the mandrel.

Radially outwardly of the path of the mandrels, and mounted upon bar 38, is a backing plate 42 bearing a frictional shoe 44. Shoe 44, which may be made of an oil-resistant material such as neoprene which exhibits a high coefficient of friction upon steel, is mounted to the backing plate by means of bolts 96 or the like. The inner edge of shoe 44 actually extends slightly radially inwardly of mandrel 10, so that the mandrel positively engages the surface of the shoe.

Also disposed upon bar 38 is stripper arm 46. Bolts 98 secure the flange of collar 48 to the stripper bar, while a through bolt 99 serves to pinch the split sides of the collar together to provide a tight frictional fit over bar 38. As is shown in exaggerated form, the inner surface of stripper arm 46 is displaced radially outwardly of the surface of mandrel 10 in order to leave a gap large enough to accept the undistorted sidewall of can 94, but too small to receive rollback 100. As should now be apparent, as the vacuum draws can 94 on the mandrel rollback 100 will abut the outer surface of the stripper arm so that the can 94 cannot seat upon the mandrel.

Further rotation of transfer drum 12 will bring passage 82 out of registration with the vacuum passage 79 of manifold 76, so that neutral pressure occurs within can 94. At this point the can is no longer being placed upon the mandrel, and the mandrel will pass out from under stripper arm 46 with the can in its extended position, as depicted. The rightward end of the can, since it extends outwardly from the mandrel, comes within the field of proximity detector 32 and causes the proximity detector to actuate solenoid valve 56 to apply compressed air to conduit 80. At this point, passageway 81 of manifold 76 is in registry with passage 82 within the transfer drum so that the compressed air can flow through passageways 82, 84 and out duct 92 to expel the can from the mandrel.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. In a container handling apparatus for transporting metal cans along a predetermined path and having a series of moving mandrels for receiving cans and conveying them along the path, means for urging cans onto ones of said mandrels, and means for sensing the presence of a can which is not fully seated upon a mandrel, the improvement comprising:

a shoe disposed adjacent a segment of the path traversed by said mandrels for frictionally engaging said mandrels to cause said mandrels to rotate; and a substantially rigid, elongate stripper arm disposed adjacent at least a portion of said segment and including an edge section extending generally parallel to said path, said edge section being sufficiently close to the mandrel surfaces to prevent cans having rolled-back edges from fitting between said stripper arm and said mandrel surfaces, but permitting the passageway therebetween of sidewalls of undeformed cans;

whereby cans having rolled back edges are prevented from fully seating upon said mandrels.

2. The apparatus according to claim 1, further including means for forcibly ejecting protruding cans from said mandrels.

3. Apparatus according to claim 2, wherein said shoe comprises a rigid supporting member, and a shoe segment of frictional material attached thereto for frictionally engaging the surfaces of ones of said mandrels.

4. Apparatus according to claim 3, further including means for pivotally mounting said stripper arm adjacent the path of said mandrels.

5. Apparatus according to claim 4, wherein said last-named means comprises means frictionally coupling said stripper arm to said support.

6. Apparatus according to claim 5, wherein said elongate stripper arm extends from the point of mounting in the direction of rotation of said mandrels and commences in a first, major portion and terminates in a second, minor portion of substantially lesser cross-sectional area than said first, major portion.

7. Apparatus according to claim 1, wherein said shoe comprises a substantially rigid shoe support, and a length of resilient frictional material attached thereto.

8. Apparatus according to claim 7, further including a pair of substantially rigid bars extending generally parallel to said mandrels, said shoe being rigidly attached to both of said bars, said elongate stripper arm being frictionally coupled to one of said bars.

9. Apparatus according to claim 1, wherein said elongate stripper arm comprises a major portion of relatively large cross-sectional area and a contiguous, terminal portion comprising a frangible extention thereof, said terminal portion being coupled to said major portion by a means having lesser shear strength than said major portion.

10. Apparatus according to claim 9, wherein said stripper arm is formed of a generally planar segment of resin-filled laminate.

11. Apparatus for transporting and coating metal cans, comprising:

a plurality of mandrels for receiving metal cans thereon, said mandrels being rotatably mounted upon a rotatable transfer drum to traverse a generally circular path;

a coating head adjacent the path described by said mandrels for applying a coating to cans disposed upon said mandrels;

means for applying a vacuum about the ends of the mandrels for urging cans into a seated position thereupon;

pneumatic means for selectively applying pneumatic pressure to said ends of the mandrels for ejecting selected ones of said cans;

sensing means for actuating said pneumatic means in response to the presence of a can not fully seated upon a mandrel;

an arcuate shoe disposed concentrically about said transfer drum for engaging each mandrel in succession to cause said mandrels to rotate;

arcuate stripper means disposed concentrically about said transfer drum and spaced from the surfaces of the mandrels for preventing cans having rolled-back edges about the open ends thereof from being fully received upon ones of said mandrels;

whereby cans having rolled-back edges at the open ends thereof are detected by said sensing means and are discharged by said pneumatic means.

12. Apparatus according to claim 11, wherein said arcuate shoe comprises a length of frictional material affixed radially inwardly thereon for engaging ones of said mandrels.

13. Apparatus according to claim 12, further including means for pivotally supporting said stripper means, and a coupling for frictionally connecting said pivotally supporting means and said stripper means.

14. Apparatus according to claim 13, wherein said stripper means comprises a rigid arm having a first, major portion and terminating in a second, minor portion, said minor portion having a lesser cross-sectional area than said major portion to allow said stripper means to fracture in a predetermined area.

* * * * *